United States Patent [19]

Murphy

[11] Patent Number: 4,667,558

[45] Date of Patent: May 26, 1987

[54] MUSIC RACK FOR ORGANS

[76] Inventor: Reuel A. Murphy, 5200 Cavitt Stallman, Roseville, Calif. 95678, Lu Verna M. Murphy, executrix

[21] Appl. No.: 766,252

[22] Filed: Aug. 16, 1985

[51] Int. Cl.[4] ..... G10C 3/02

[52] U.S. Cl. ..... 84/180

[58] Field of Search ..... 84/178, 180; 362/98

[56] References Cited

U.S. PATENT DOCUMENTS

| | | | |
|---|---|---|---|
| 315,558 | 4/1885 | Scanlan et al. | 84/180 |
| 690,351 | 12/1901 | Bowen | 84/180 |
| 1,347,645 | 7/1920 | Manny | 362/98 |
| 1,847,051 | 2/1932 | Zabach | 362/98 |
| 2,470,674 | 5/1949 | Zaiser | 84/178 |

*Primary Examiner*—L. T. Hix
*Assistant Examiner*—Brian W. Brown
*Attorney, Agent, or Firm*—Mark C. Jacobs

[57] ABSTRACT

This invention is a rack for attachment to organs for purposes of holding books of music or sheets of music for the organist to see when playing;

The rack is characterized by comprising a backing with a shelf upon which the music rests which backing and shelf are so constructed as to be able to move upward and downward with relation to the keyboard of the organ and also to move closer to or farther away from the organist and to tilt at varying angles with relation to the line of sight of the organist's eyes.

6 Claims, 7 Drawing Figures

84
2
85
65
61
63
80
73
62
50
60
10
15
2
13
51
64
12
11
20
21
14

85
80
73
72
71
84
81
83
61
76
60
79
58
57
55
3
56a
56
50
52
63
15
3
62
16
53
54
51
54
53

111
160
110
112
120
123
122
124
113
122
114
150

51
52
56
56a
55a
73
77
72
77a
61
74
79
59
58
76
60
75a
75
63
62
57
55
81
82
83
84
80
85
53
54
155
156

MUSIC RACK FOR ORGANS

CROSS REFERENCE TO RELATED PATENT APPLICATIONS

There are no patent applications filed by me related to the within application.

BACKGROUND OF THE INVENTION

I. Field of the Invention

This invention is in the general field of organs; the invention is more particularly related to racks associated with organs for holding sheet music or books of musical compositions in such manner that the organist can read them conveniently; the invention is even more directly related to a rack of such nature which is mounted upon the organ and is adjustable thereon so as to be lowered or elevated with relation to the keyboard and adjustable to positions closer to, or further away from the organist, and further adjustable as to the angle of repose of the sheet music or book of music with relation to the vertical.

II. Description of the Prior Art

There is no device of this nature known to me in the prior art. All of the prior art in the holding of sheet music or books of music for organs comprises an easel type holder or the like fixed in one position on the top or adjacent the front of an organ. In some cases the easels or music holders are hinged in their connection to the top of the organ but this only makes it possible for the item to lay flat on the top of the organ not to be moved forward and backward or up and down or to be pivoted within fixed or fixable ranges of angularity. In that sense, there is no prior art.

SUMMARY OF THE INVENTION

There are many organs in use by persons throughout the world, and particularly in the United States. Many of the organs in use are used by persons of all age groups and persons of various physical abilities for personal, family, or group entertainment.

Since there is such a wide variety of persons using organs, some have vision problems, some have certain physical problems, some have different seating and movement characteristics. Each individual has his or her own individual requirements for the vision of music being displayed in conjunction with the organ and to be played with the organ.

Additionally, organs, in general, require considerable footwork on various treadles and pedals which footwork must be coordinated with the handwork on the organ.

In order to accomplish proper footwork in conjunction with the handwork on the organ it is necessary that the organist sit in a relatively fixed position. When it is necessary for an organist to lean forward to an unusual degree in order to properly read the music or to lean backwards for the same reason, this interferes greatly with the organist's ability to manipulate both the foot and hand controlled mechanisms.

Also, there is no accommodation available, prior to this invention, for different heights to hold the music for accommodation of different sized individuals. A taller person requires a different posturing of the music than does a shorter person.

Likewise, the posturing of the music is both in the sense of the posturing for height and distance from the organist as well as the angle of repose, depending upon all of the different factors involved.

I have studied this problem considerably and have now conceived and developed a unique movable holder for the music in conjunction with an organ.

The manner in which I have accomplished this is to provide for a music rack or stand which is mounted in conjunction with an organ in a manner wherein the music rack carrying the music may be moved closer or farther away from the organist and may also be moved upwardly or downwardly for proper eye alignment. Additionally, the music may be tilted in appropriate manner so that the individual's correct requirements are met.

In accomplishing this, I had to spend considerable time making the rack in such manner that it would not interfere with the tabs or other functional parts of the organ.

Further, in accomplishing the ends desired, I discovered that by positioning the music rack in a particular manner the sound emanating from many organs can be greatly enhanced. This apparently is due to a baffling action of sounds over the keyboard.

In making the device I have provided a pair of slides with telescoping elements carrying another pair of slides with telescoping elements, pivotally connected to the first pair of slides, wherein the first pair of slides has mounted thereon means to adjust the telescoping elements and to then hold them in any given desired temporarily fixed position. The second pair of slides has mounted to it the music carrying rack and is also adjustable pivotally and vertically with relation to the first pair of slides which is generally horizontally mounted to the organ.

I have also provided certain power features so that the user of the organ may adjust the position of the music both horizontally and vertically by merely pressing a control button or the like whenever it is desired to change the positioning of the music. In this embodiment it is not necessary for a user to physically change the positioning of the music.

It is an object of this invention to provide a music carrying rack which is cooperatively connected to an organ;

Another object of this invention is to provide a music carrying rack of the nature described wherein the rack is movable closer to or farther away from the organist;

Another object of this invention is to provide such a music carrying rack as has been described wherein the music being displayed may be elevated and tilted at various angles.

The foregoing and other objects and advantages of this invention will become apparent to those skilled in the art upon reading the description of a preferred embodiment which follows in conjunction with a review of the appended drawings.

BRIEF DESCRIPTION OF THE DRAWINGS

FIG. 6 illustrates an apparatus for power control of an apparatus for practicing the method of this invention.

DESCRIPTION OF A PREFERRED EMBODIMENT

Figure 1:
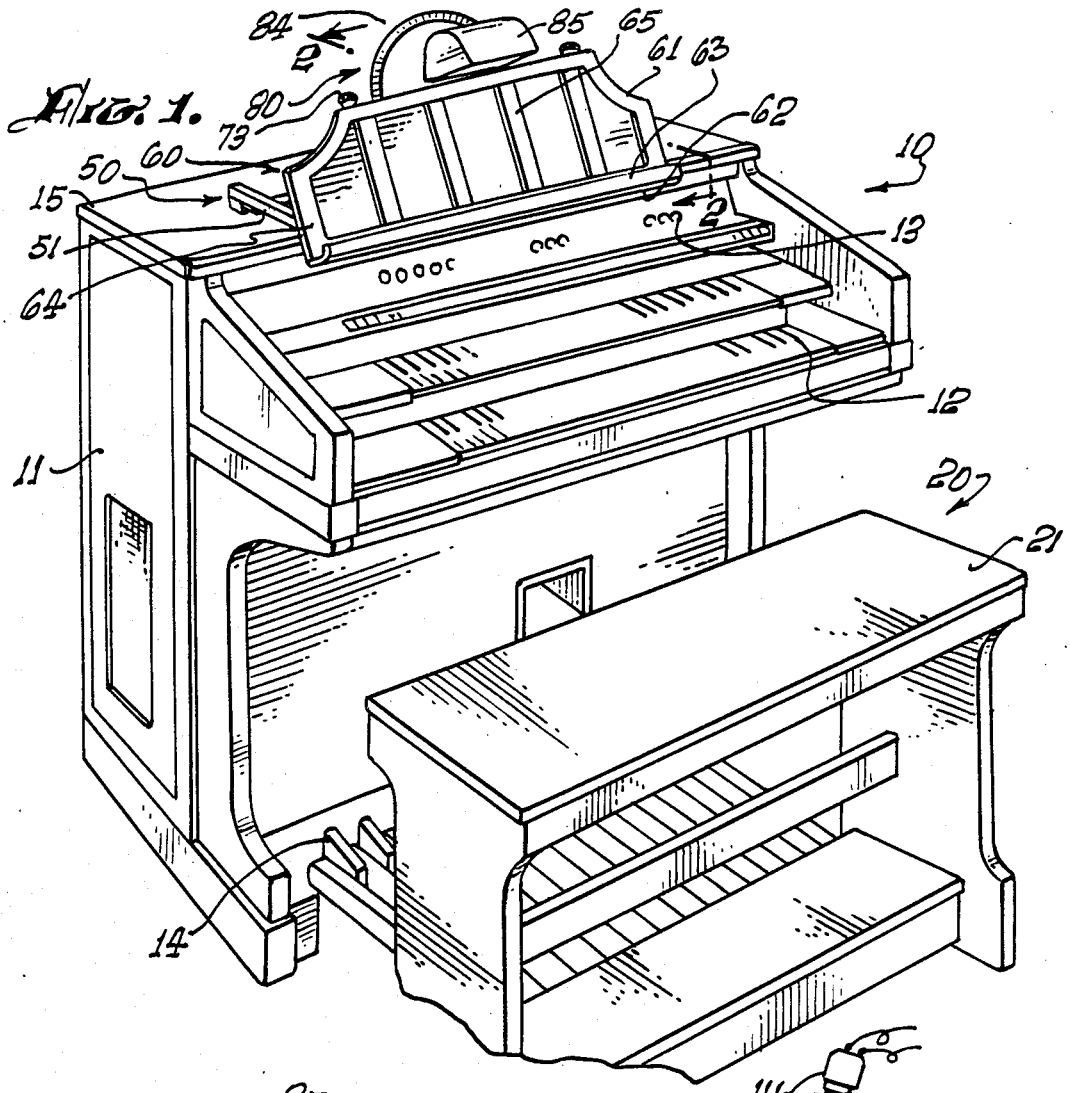
FIG. 1 is a perspective of an organ with certain elements not shown and a portion broken away wherein a preferred embodiment of an apparatus to practice the method of this invention is shown mounted upon the organ.

FIG. 1 illustrates an organ generally 10 having a customary seat generally 20 with a benchlike upper surface 21 upon which the organist is seated. The organ generally 10 has the usual cabinet construction 11 with keyboards 12 and various control buttons and tabs 13 as are known to those skilled in the art. Various pedals and treadles 14 will commonly exist, again, as known to those skilled in the art.

In playing the organ, the organist will sit on the platform 21 and will operate the pedals and treadles 14 with his or her feet and will handle the keyboard 12 and the auxiliary controls 13 with his or her hands.

The top of the organ is generally a flat element 15 made of wood or the like.

The apparatus to practice the method of this invention is shown in FIG. 1 to comprise primarily a mounting slide arrangement generally 50 fastened to the top 15 of the organ with the music holding stand generally 60 including a panel of wood or the like usually having a design of carved or raised wooden elements 61, 63, 64, and 65. A holding shelf 62 is provided in conjunction with the element 60 to actually carry the sheet music, or book of compositions which the organist will be playing from.

Preferably, the element 62 will also carry a lamp generally 80 including a light housing 85 and a flexible gooseneck arrangement 84.

Figures 3, 4, 5, 5A:
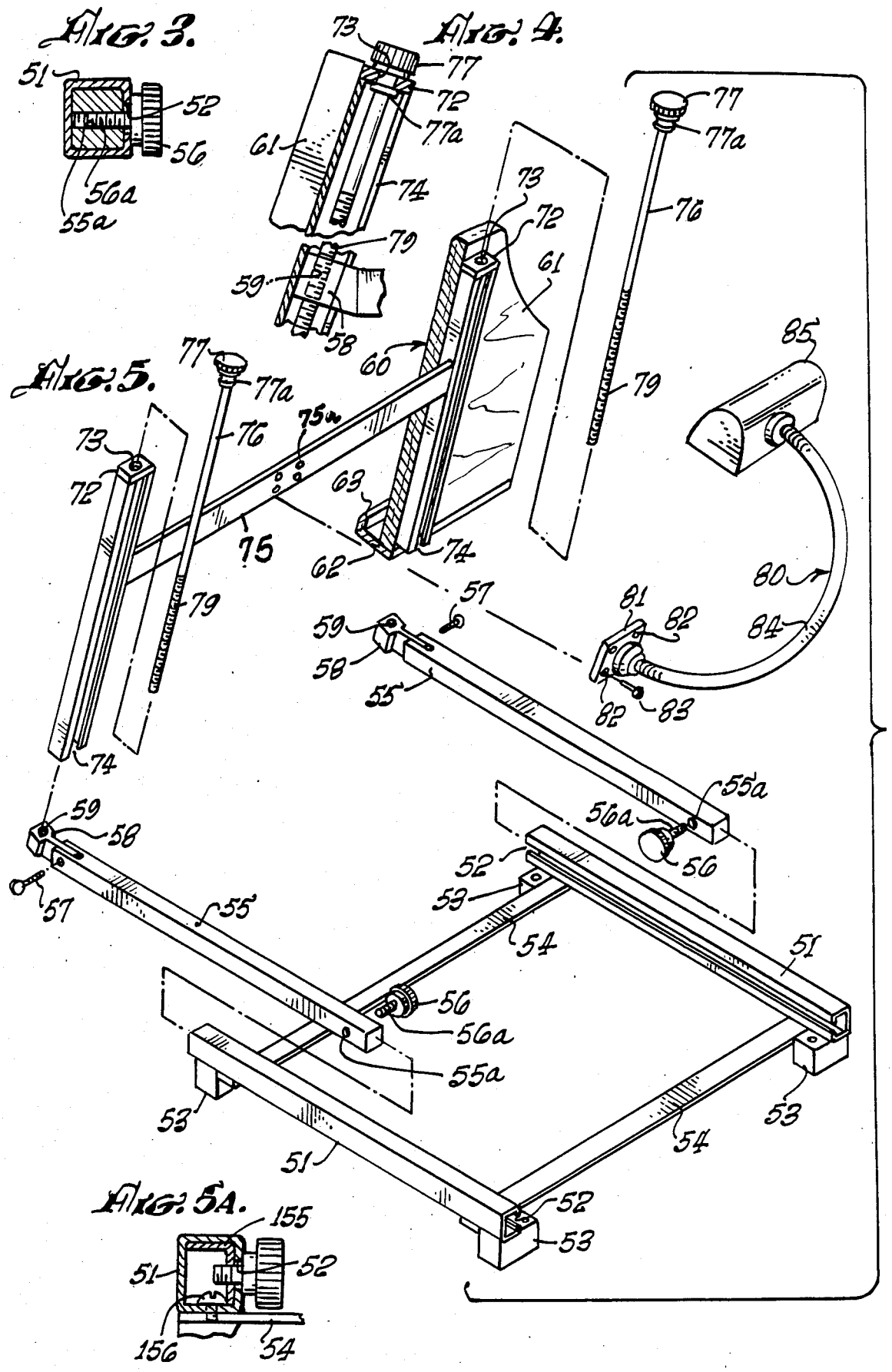
FIG. 3 is a section on 3—3 of FIG. 2.
FIG. 4 is a partially broken away, partially sectioned view of one of the elements 71 shown hereafter in FIG. 5.
FIG. 5 is an exploded view of the elements of the preferred embodiments of an apparatus for practicing the method of this invention.
FIG. 5A is a schematic sectionalized view of a typical slide 51 utilizing an alternate interior slide element.

With attention now directed primarily to FIGS. 2, 3, 4 and 5, the overall mounting for the element 60 will be better understood. Looking particularly at the exploded view, FIG. 5, it will be noted that there is a framework comprising two slides or the like 51 connected together by two bars or the like 54 welded, or otherwise fastened, to the slides 51. The combination of slides 51 and 54 will be fastened by welding, screws, or the like to mounting blocks 53 which may be made of wood or metal. Each of the mounting blocks 53 will preferably have a hole 52 through which a screw of the like may be inserted for secure fastening to the top of the organ. Each of the members 51 will have a slot 52 in one side as indicated. Two slides 55 will be provided, these slides will slide within the members 51 and each will have a threaded hole 55*a* which accommodates a threaded shaft 56*a* connected to an enlarged knob or the like 56. With the threaded shaft 56*a* threaded into the hole 55*a*, the threaded shaft extends through the opening 52 in member 51. When the slides 55 are in the desired position the knob 56 is tightened with the result as shown in FIG. 3 wherein the slide 51 is held firmly in a fixed position, but it will be movable upon loosening the knob 56 so that it can once again be moved in its carrying element 51.

At one end of each of the members 55, there is a slot which accommodates a tang on element 58. A threaded wing nut 57 holds this tang by means of a threaded hole as shown. It may be moved pivotally and then fastened in the desired angular position by means of the wing nut 57. Element 58 has a threaded hole 59 which accommodates threaded portion 79 of rod 76. The rod 76 has an enlarged knob 77 at the top and a collar 77*a* as indicated. The collar 77*a* is rotatably held within the hole 73 of plate 72 fastened to upright members 74. The upright members 74 are connected together by welding or the like at the ends of strap 75. A series of holes 75*a* are provided in strap 75 for mounting lamp 80 to its base 81 by means of screws or the like 83 through holes 82. This lamp has a lamp shield 85 within which is a lamp of customary construction and may be either powered by batteries contained within the shield 85 or by a cord of the like (not shown) through the gooseneck 84. The elements 74 are fastened with screws or the like (not shown) to the music holding board 61. The music holding shelf 62 with lip 63 may be permanently fastened to the board 61 by gluing or the like, or may have a hinge (not shown) if desired.

FIG. 4 shows the manner in which the collar 77*a* is held within the plate 72 which is fastened to item 74. As shown, when the knob 77 is turned, the threaded portion 79 engaged in the threaded hole 59 of element 58 will cause the entire music holding board 61 to be raised or lowered.

At FIG. 5A there is shown in cross section an alternate embodiment of the slide element 55 wherein slide element 155 is in the shape of an angle in order to clear screws 156 used to fasten slide element 51 to cross member 54.

Figure 2:
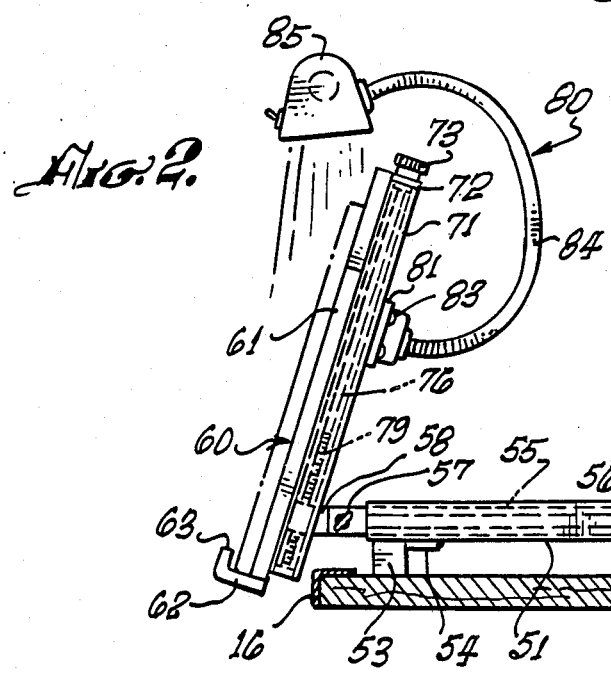
FIG. 2 is a section on 2—2 of FIG. 1.
Figure 2A:
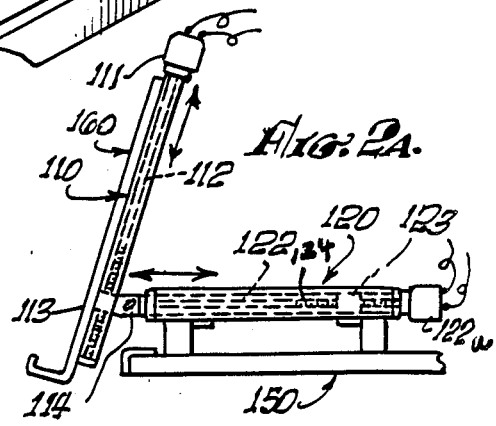
FIG. 2A is a schematic, partially broken away, partially in phantom side elevation of an alternate embodiment of the apparatus of FIG. 2.

Another alternate embodiment of this invention is shown schematically and in phantom side elevation at FIG. 2A. In this case the slides 51–55 have been replaced by a threaded block 123 with a screw 124 sliding in a slide 122 on an organ top 150, powered by a motor 122*a*. Likewise, the music holding rack 160 is mounted upon elements 110 and the screw 76 has been replaced by a rod 112 powered by a motor 111. When activated, the rod 112 will raise or lower the music holding board in the same manner as shown in FIG. 4 above, except by operation of the motor. The construction and electrical connections of such motors as are shown by 111 and 122*a* are well known to those skilled in the art and this particular construction will become apparent to those skilled in the art upon its having been revealed in this manner to them. If this embodiment is used, switches in the form of push buttons or the like will be available in connection with the organ console so that they can be easily activated.

While the embodiments of this invention shown and described are fully capable of achieving the objects and advantages desired, it is to be understood that such embodiments are for purposes of illustration only and not for purposes of limitation.

I claim:

1. In combination with an organ, a device for holding sheet music for the organist which device comprises:

a music carrying means for holding sheet music in a relatively vertical position, having a holding shelf at the lower end thereof;

a second means to move said music carrying means upwardly and downwardly with respect to a mounting means, a third slidable means pivotally attached by pivot means to said second means, said pivot means being secured to said third means at the forward end thereof, for moving said music carrying means proximate and distant an organist, said pivot means adapted to control the relatively vertical position of the music carrying means, mounting means secured beneath the third slidable means for disposition upon the top of an organ, the said music carrying means being limited in its vertical movement's lowermost position, to a locus above to adjacent the top of said organ, and means for activating the movement of said music carrying means inwardly and outwardly, and upwardly and downwardly.

2. The apparatus of claim 1 wherein the means to raise and lower the music carrying device includes at least one threaded screw.

3. The apparatus of claim 1 wherein the means for moving the music carrying means upwardly and downwardly is connected to the means for horizontally moving said music carrying means, by a swivel means.

4. The apparatus of claim 1 further includes a lamp suitable to shine upon sheet music disposed upon the sheet music carrying means.

5. A device for holding sheet music for the organist, which comprises:

a music carrying means for holding sheet music in a relatively vertical position, having a holding shelf at the lower end thereof;

a second means to move said music carrying means upwardly and downwardly with respect to a mounting means, a third slidable means pivotally attached by pivot means to said second means, said pivot means being secured to said third means at the forward end therof, for moving said music carrying means proximate and distant an organist, said pivot means adapted to control the relatively vertical position of the music carrying means, mounting means secured beneath the third slidable means for disposition upon the top of an organ, the said music carrying means being limited in its vertical movement's lowermost position, to a locus above or adjacent the top of said organ, and means for activating the movement of said music carrying means inwardly and outwardly, and upwardly and downwardly, and means for mounting said device to an organ.

6. The device of claim 5 further including a lamp mounted on said device and adapted to shine on music to be carried by said device.

* * * * *